US009437973B2

(12) United States Patent
Kamei

(10) Patent No.: US 9,437,973 B2
(45) Date of Patent: Sep. 6, 2016

(54) CONNECTOR FOR PREVENTING RELEASE OF AN OBJECT RECEIVED THEREIN IN AN EJECTING DIRECTION

(71) Applicant: JAPAN AVIATION ELECTRONICS INDUSTRY, LIMITED, Shibuya-ku, Tokyo (JP)

(72) Inventor: Yuji Kamei, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/684,905

(22) Filed: Apr. 13, 2015

(65) Prior Publication Data

US 2015/0372420 A1 Dec. 24, 2015

(30) Foreign Application Priority Data

Jun. 24, 2014 (JP) ..... 2014-129612

(51) Int. Cl.
*H01R 13/62* (2006.01)
*H01R 13/633* (2006.01)
*H01R 13/60* (2006.01)

(52) U.S. Cl.
CPC ..... *H01R 13/633* (2013.01); *H01R 13/60* (2013.01); *H01R 13/62* (2013.01)

(58) Field of Classification Search
CPC ..... H01R 13/62938; H01R 13/6272; H01R 13/6275; H01R 13/62933; H01R 13/465; H01R 13/641
USPC ..... 439/157, 352, 357, 372, 488, 489
See application file for complete search history.

(56) References Cited

U.S. PATENT DOCUMENTS 5,057,029 A 10/1991 Noorily
5,135,408 A * 8/1992 Suzuki ..... H01R 13/639 439/157

(Continued)

FOREIGN PATENT DOCUMENTS

| | | | |
|---|---|---|---|
| JP | 05013129 | A | 1/1993 |
| JP | 2000228248 | A | 8/2000 |
| JP | 2000340294 | A | 12/2000 |
| JP | 2001297823 | A | 10/2001 |
| JP | 2006059827 | A | 3/2006 |
| WO | 9427342 | A1 | 11/1994 |

OTHER PUBLICATIONS

Extended European Search Report dated Sep. 2, 2015, issued in counterpart European Application No. 15164340.0.

*Primary Examiner* — Thanh Tam Le
(74) *Attorney, Agent, or Firm* — Holtz, Holtz & Volek PC

(57) ABSTRACT

A connector is receivable an object along a receiving direction. The connector ejects the object along an ejecting direction opposite to the receiving direction. The object has a mating terminal, a pressed portion and a regulated portion. The connector comprises a holding member, a terminal and an operation member. The operation member is supported by the holding member so as to be movable between a first position and a second position. The operation member includes a press portion and a regulating portion. When the operation member is operated to be moved from the first position toward the second position, the press portion presses the pressed portion in the ejecting direction to move the object in the ejecting direction. At the latest until the operation member reaches the second position, the regulating portion enters into an ejecting path to regulate a movement of the regulated portion in the ejecting direction so that the regulating portion prevents the object from being released off the connector in the ejecting direction. The ejecting path is a movement path on which the regulated portion passes when moved in the ejecting direction.

9 Claims, 10 Drawing Sheets

(56) References Cited

U.S. PATENT DOCUMENTS 5,429,523 A 7/1995 Tondreault
5,474,461 A * 12/1995 Saito ..... H01R 13/62933 439/157
5,476,391 A * 12/1995 Katsuma ..... H01R 13/62933 439/155
5,848,908 A * 12/1998 Katsuma ..... H01R 13/62955 439/157
6,644,996 B2 * 11/2003 Yamashita ..... H01R 13/641 439/352
7,326,074 B1 * 2/2008 Lim ..... H01R 13/629 439/352
7,632,116 B2 * 12/2009 Lee ..... H01R 13/635 439/157
7,980,880 B2 * 7/2011 Kodama ..... H01R 13/6272 439/352
8,641,433 B2 * 2/2014 Uchida ..... H01R 13/62955 439/157
2009/0263995 A1 10/2009 Murayama et al.
2014/0154910 A1 6/2014 Conway et al.

* cited by examiner

CONNECTOR FOR PREVENTING RELEASE OF AN OBJECT RECEIVED THEREIN IN AN EJECTING DIRECTION

CROSS REFERENCE TO RELATED APPLICATIONS

An applicant claims priority under 35 U.S.C. §119 of Japanese Patent Application No. JP2014-129612 filed Jun. 24, 2014.

BACKGROUND OF THE INVENTION

This invention relates to a connector comprising an operation member such as a lever.

As shown in FIG. 17, JP-A2001-297823 (Patent Document 1) discloses a connector 500. The connector 500 receives an object (relay) 501 along a receiving direction (RD). The connector 500 ejects the object 501 along an ejecting direction (ED) opposite to the receiving direction when an operation member 502 is operated. The connector 500 has terminals (not shown). The object 501 has mating terminals 503. Since contact forces between the terminals (not shown) and the mating terminals 503 are large, it might be difficult to directly pull the object 501 out from the connector 500. Even in that case, because the operation member 502 uses a principle of lever, the object 501 can be pulled out therefrom by operating the operation member 502 with a small force.

However, the connector 500 of Patent Document 1 has a drawback that the object 501 might be released off the connector 500 when the operation member 502 is operated to pull object 501 out from the connector.

SUMMARY OF THE INVENTION

It is therefore an object of the present invention to provide a connector which prevents the object from being released off the connector when an operation member is operated in order to pull the object out from the connector.

One aspect (first aspect) of the present invention provides a connector receivable an object along a receiving direction. The connector ejects the object along an ejecting direction opposite to the receiving direction. The object has a mating terminal, a pressed portion and a regulated portion. When the object is moved in the receiving direction, the regulated portion is moved in the receiving direction together with the object. When the object is moved in the ejecting direction, the regulated portion is moved in the ejecting direction together with the object. The connector comprises a holding member, a terminal and an operation member. The terminal is held by the holding member. When the connector receives the object, the terminal is connected with the mating terminal. The operation member is supported by the holding member so as to be movable between a first position and a second position. When the connector receives the object, the operation member is positioned at the first position. The operation member includes a press portion and a regulating portion. When the operation member is operated to be moved from the first position toward the second position, the press portion presses the pressed portion in the ejecting direction to move the object in the ejecting direction. At the latest until the operation member reaches the second position, the regulating portion enters into an ejecting path to regulate a movement of the regulated portion in the ejecting direction so that the regulating portion prevents the object from being released off the connector in the ejecting direction. The ejecting path is a movement path on which the regulated portion passes when moved in the ejecting direction.

Another aspect (second aspect) of the present invention provides a connector device comprising the connector of the first aspect and a mating connector as the object. The mating connector comprises a mating holding member which holds the mating terminal. The pressed portion and the regulated portion are provided on the mating holding member.

According to the present invention, until the operation member reaches the second position, the regulating portion enters into the ejecting path, which is the movement path on which the regulated portion passes when moved in the ejecting direction. The entering of the regulating portion regulates the movement of the regulated portion in the ejecting direction. Accordingly, the regulating portion can prevent the object from being released off the connector.

An appreciation of the objectives of the present invention and a more complete understanding of its structure may be had by studying the following description of the preferred embodiment and by referring to the accompanying drawings.

Figure 1:
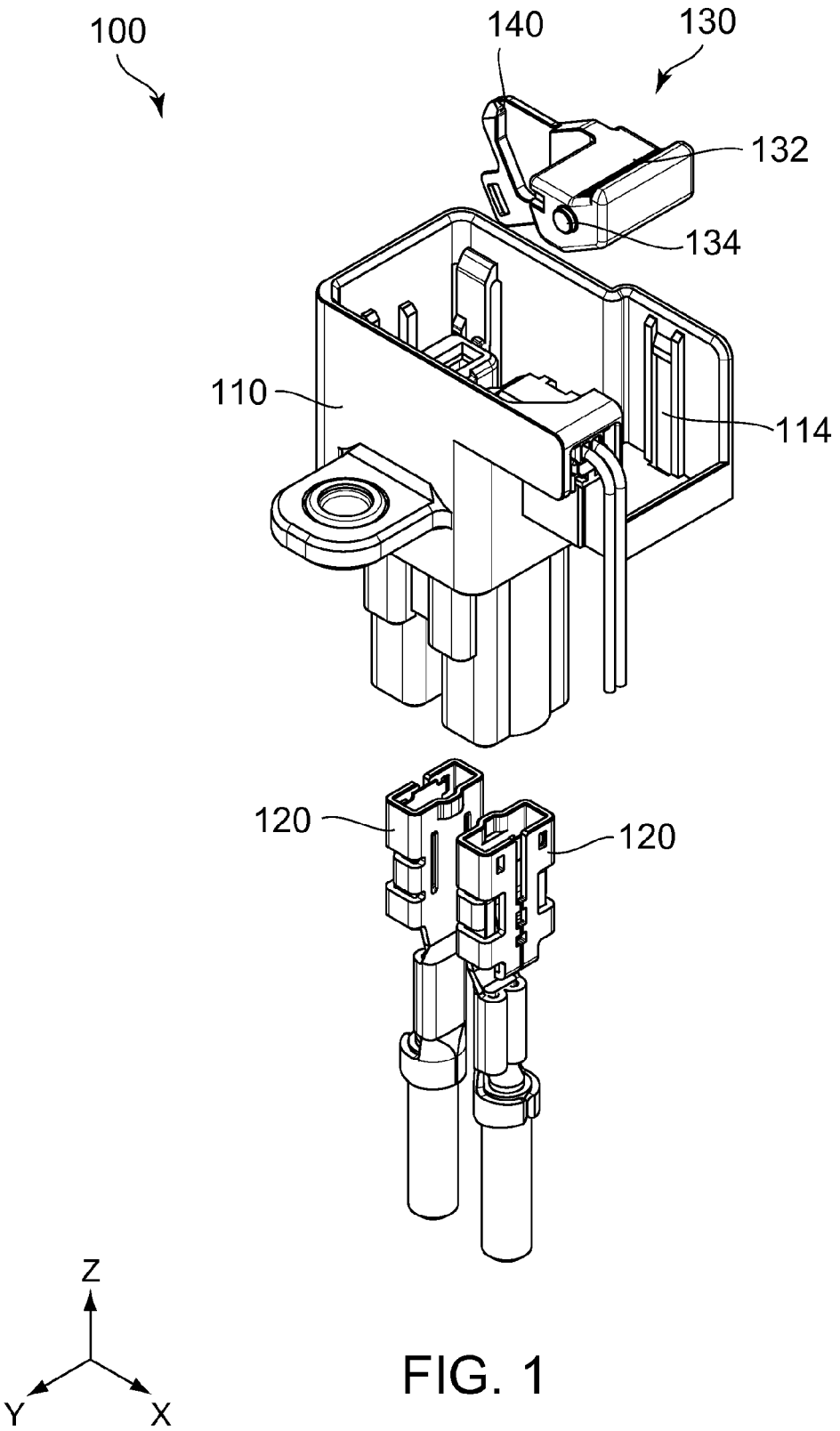
FIG. 1 is an exploded, perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 4:
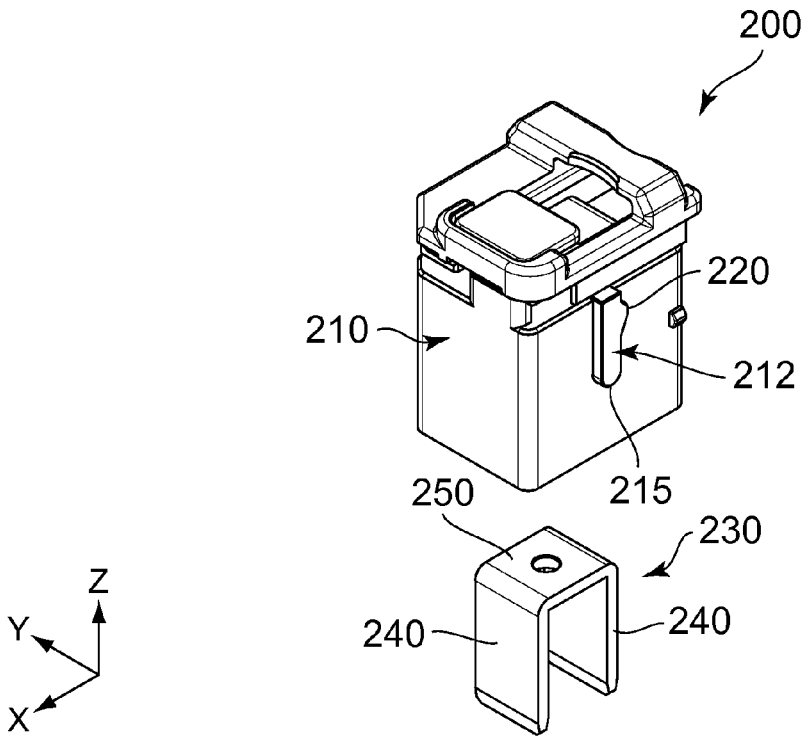
FIG. 4 is an exploded, perspective view showing a mating connector (object) mateable with the connector of FIG. 1.
Figure 7:
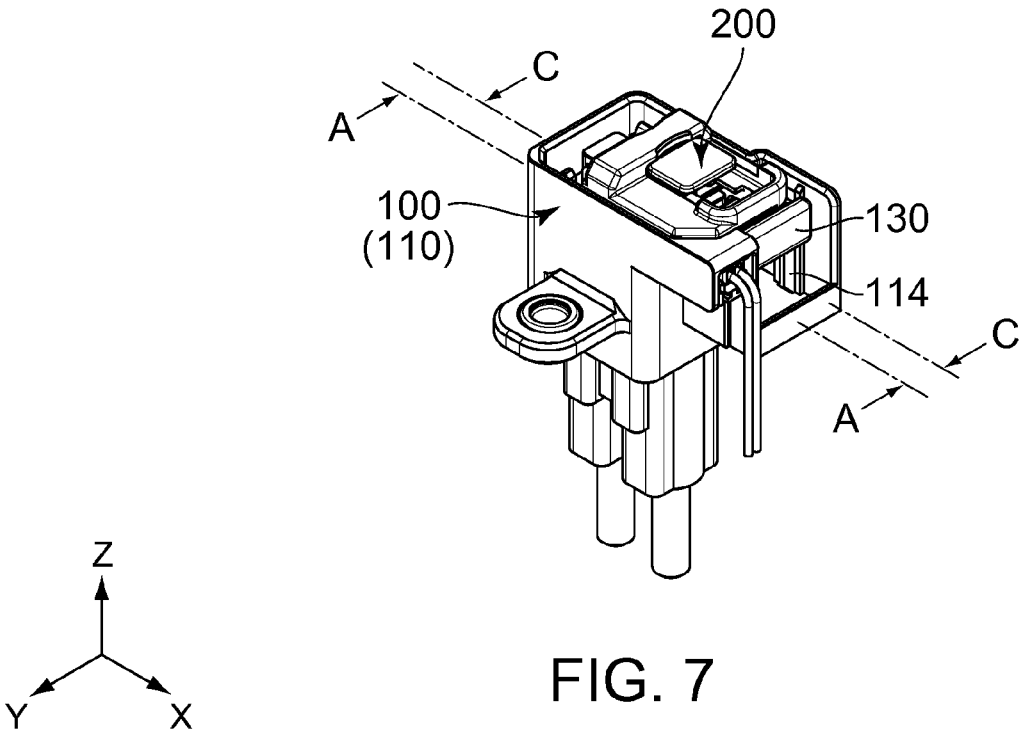
FIG. 7 is a perspective view showing a connector device which comprises the connector of FIG. 1 and the mating connector of FIG. 4. The connector receives the mating connector. The operation member is positioned at a first position.
Figure 12:
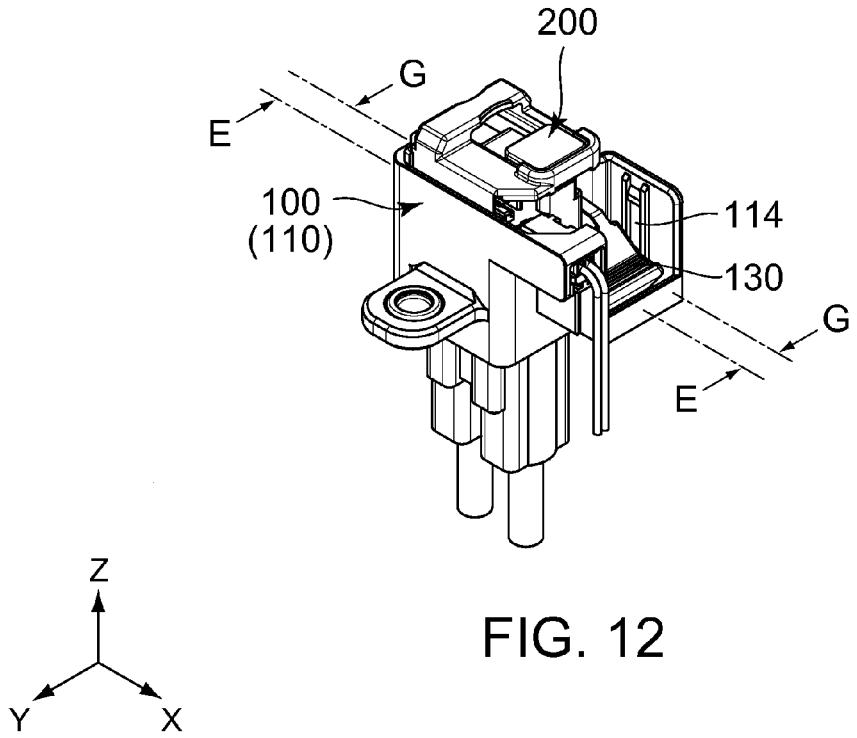
FIG. 12 is a perspective view showing the connector of FIG. 7. The operation member is positioned at a second position. The mating connector is easily pullable out from the connector.

Referring to FIGS. 1, 4, 7 and 12, a connector 100 according to an embodiment of the present invention is receivable an object (mating connector 200) along a receiving direction (downward direction: negative Z-direction) and ejects the object along an ejecting direction (upward direction: positive Z-direction) opposite to the receiving direction. As shown in FIGS. 4, 7 and 12, the object according to the present embodiment is a mating connector 200. The mating connector 200 forms a connector device together with the connector 100. In other words, the connector device according to the present embodiment comprises the connector 100 and the mating connector 200 as the object. More specifically, the connector device of the present embodiment is a service plug assembly which is used for a hybrid car or the like.

As shown in FIG. 4, the mating connector 200 comprises a mating holding member 210 and a mating terminal 230. The mating terminal 230 is held by the mating holding member 210.

Figure 5:
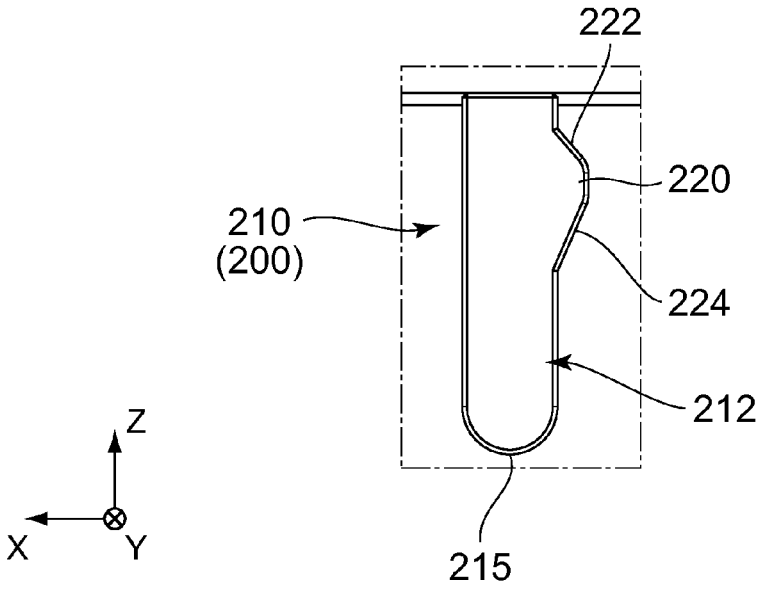
FIG. 5 is an enlarged, side view showing a part of the mating connector of FIG. 4.
Figure 6:
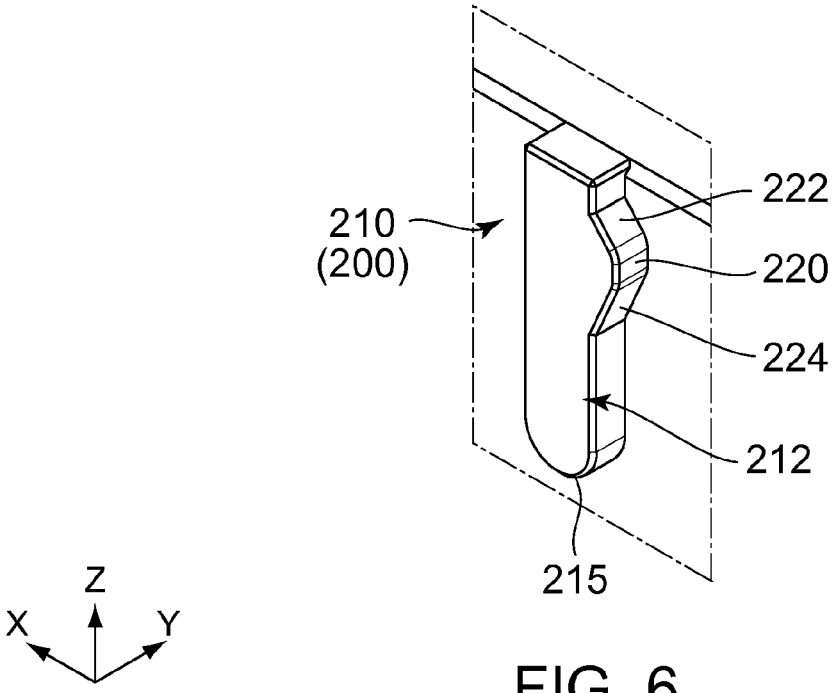
FIG. 6 is an enlarged, perspective view showing a part of the mating connector of FIG. 4.

As shown in FIGS. 4 to 6, the mating holding member 210 is formed with an island-like protrusion 212. The island-like protrusion 212 protrudes in one of thickness directions, i.e. a negative Y-direction. In this embodiment, the thickness direction is a Y-direction. A lower end, or a negative Z-side end, of the island-like protrusion 212 functions as a pressed portion 215. In addition, the island-like protrusion 212 is provided with a regulated portion 220. The regulated portion 220 protrudes in a predetermined direction perpendicular to both the thickness direction and the receiving direction. In this embodiment, the predetermined direction is an X-direction. Specifically, in the present embodiment, the pressed portion 215 and the regulated portion 220 is provided as parts of the single island-like protrusion 212, respectively. However, the present invention is not limited thereto. For example, the pressed portion 215 and the regulated portion 220 may be formed as independent protrusions, respectively.

As shown in FIGS. 5 and 6, the regulated portion 220 has a contact surface 222 and a retraction surface 224. The contact surface 222 intersects with the ejecting direction. The retraction surface 224 intersects with the receiving direction. As shown in FIGS. 7 and 12, the mating connector 200 is relatively moved along the receiving direction or the ejecting direction with respect to the connector 100. As understood from FIGS. 10 and 15, the regulated portion 220 is moved in the receiving direction or the ejecting direction together with a movement of the mating connector 200. Specifically, when the mating connector 200 is moved in the receiving direction, the regulated portion 220 is moved in the receiving direction together with the mating connector 200. In addition, when the mating connector 200 is moved in the ejecting direction, the regulated portion 220 is moved in the ejecting direction together with the mating connector 200.

Figure 9:
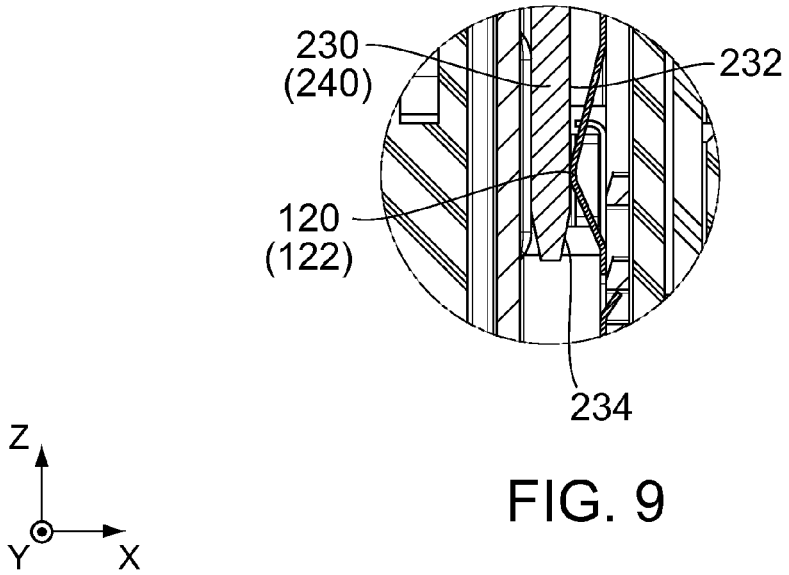
FIG. 9 is an enlarged view showing a part which is enclosed by a circle B of dashed-dotted lines of FIG. 8.
Figure 14:
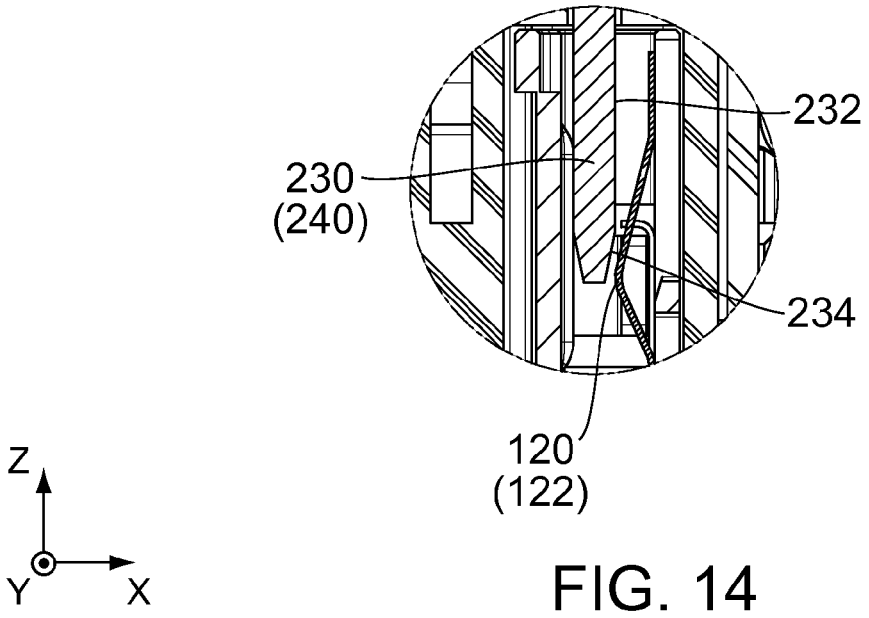
FIG. 14 is an enlarged view showing a part which is enclosed by a circle F of dashed-dotted lines of FIG. 13.

As shown in FIG. 4, the mating terminal 230 has two connection portions 240 and a coupling portion 250. The coupling portion 250 couples the two connection portions 240 with each other. The mating terminal 230 has a U-like shape as a whole. As shown in FIGS. 9 and 14, in a plane including the ejecting direction, each of the connection portions 240 has a cross-sectional shape including a linear portion 232 and a tapered portion 234 which is positioned at an end of the linear portion 232. In this embodiment, the plane is an XZ-plane.

Figure 8:
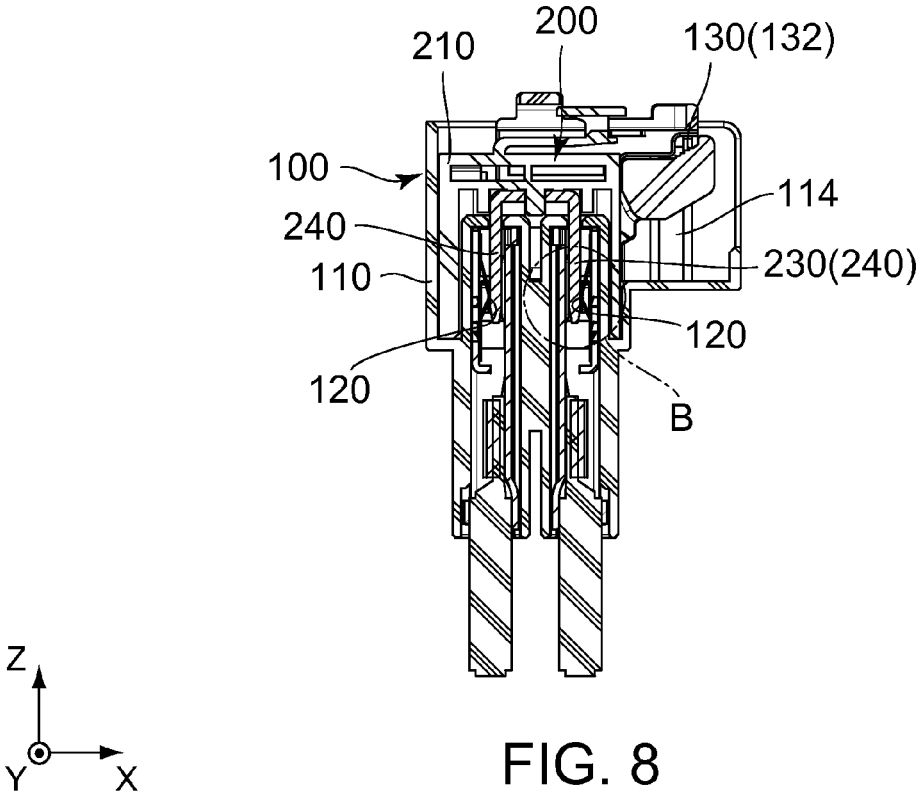
FIG. 8 is a cross-sectional view showing the connector device of FIG. 7, taken along line A-A.
Figure 13:
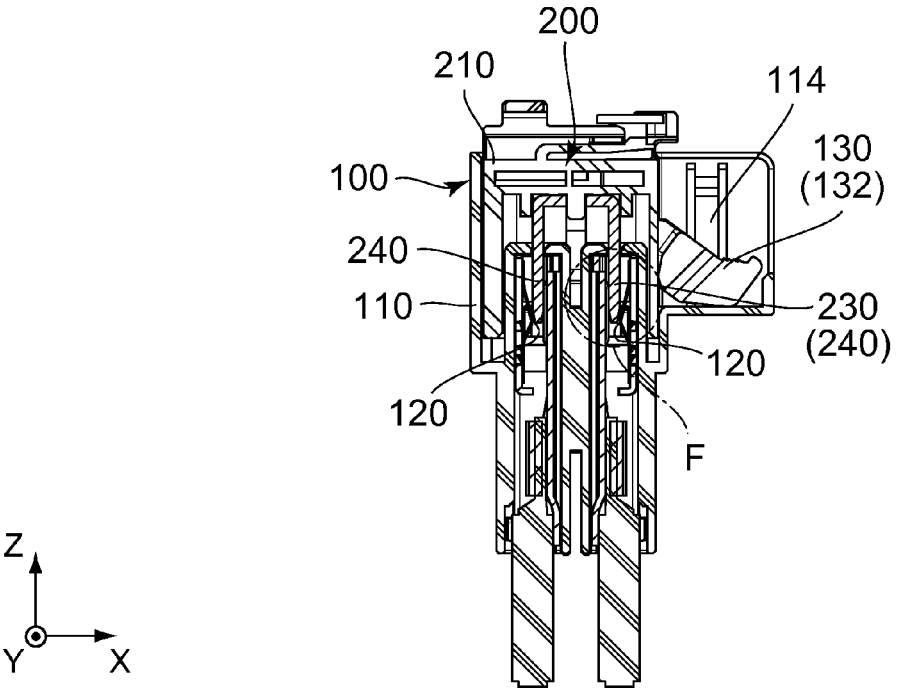
FIG. 13 is a cross-sectional view showing the connector device of FIG. 12, taken along line E-E.

As shown in FIG. 1, the connector 100 comprises a holding member 110, two terminals 120 and an operation member 130. As shown in FIGS. 8 and 13, the two terminals 120 are held by the holding member 110. As shown in FIGS. 9 and 14, each of the terminals 120 has a dog-leg like contact portion 122. As shown in FIG. 8, when the connector 100 receives the mating connector 200, the terminals 120 are connected with the mating terminal 230. In detail, as understood from FIGS. 8 and 9, when the connector 100 receives the mating connector 200, the two connection portions 240 of the mating terminal 230 are inserted into the two terminals 120, respectively, and the contact portions 122 are then brought into contact with the linear portions 232 of the connection portions 240 of the mating terminal 230, respectively. Thus, the two terminals 120 are connected with each other through the mating terminal 230 so that current can be carried from one of the terminals 120 to a remaining one of the terminals 120.

Figure 10:
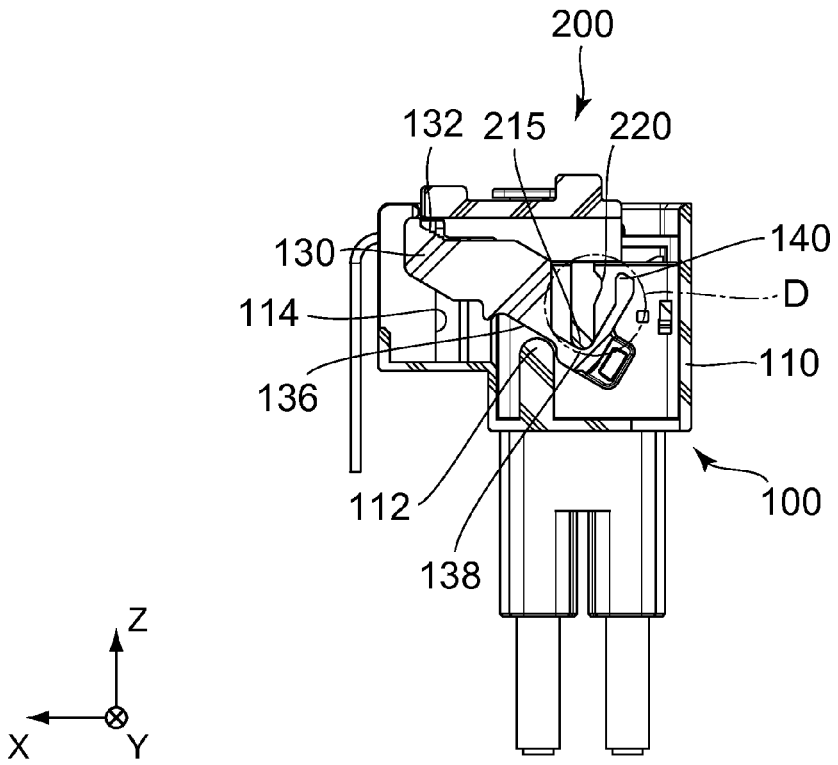
FIG. 10 is a cross-sectional view showing the connector device of FIG. 7, taken along line C-C.
Figure 15:
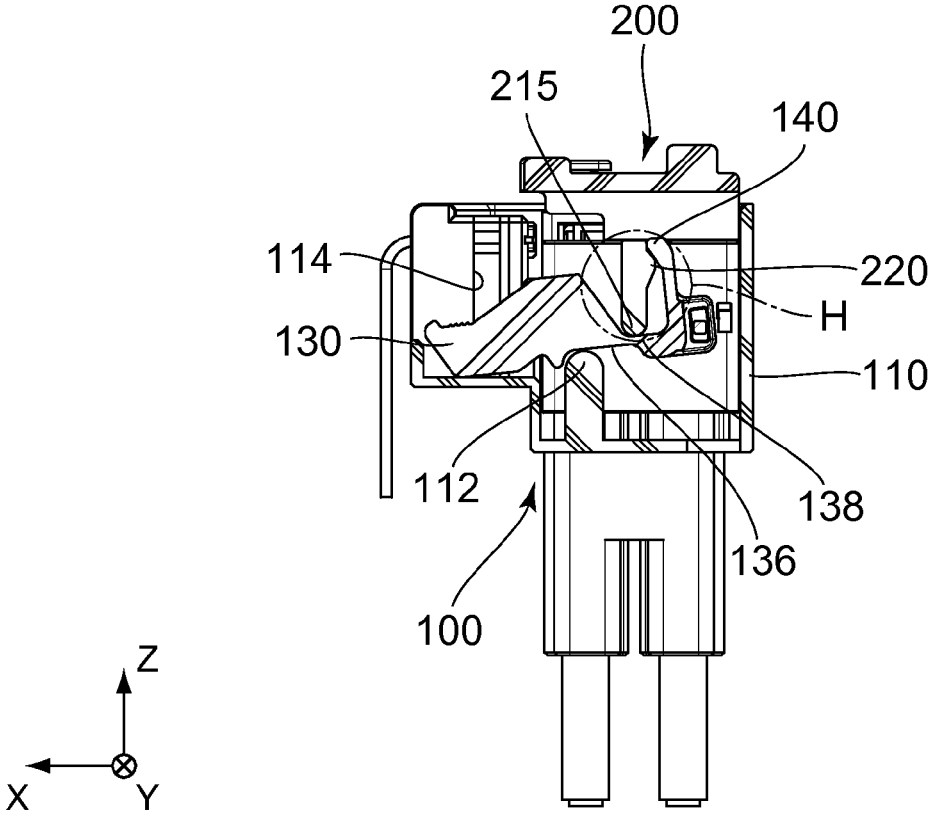
FIG. 15 is a cross-sectional view showing the connector device of FIG. 12, taken along line G-G.

As shown in FIGS. 10 and 15, the holding member 110 is formed with a support portion 112 and guide portions 114. The support portion 112 is an elongated protrusion which extends in the ejecting direction and is rounded at an end, or a positive Z-side end, thereof in the ejecting direction. As shown in FIG. 1, each of the guide portions 114 is a ditch which extends in an up-down direction, i.e. receiving direction and ejecting direction. As understood from FIGS. 7, 8 and 10, the holding member 110 is formed with two of the guide portions 114.

Figure 2:
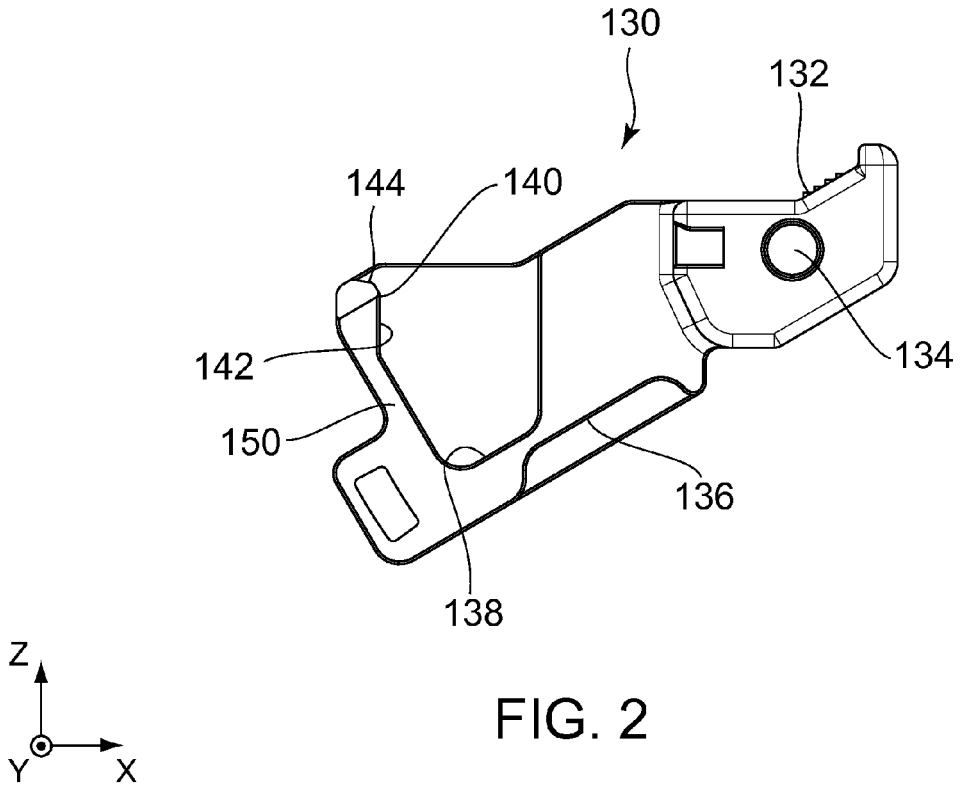
FIG. 2 is a side view showing an operation member which is included in the connector of FIG. 1.
Figure 3:
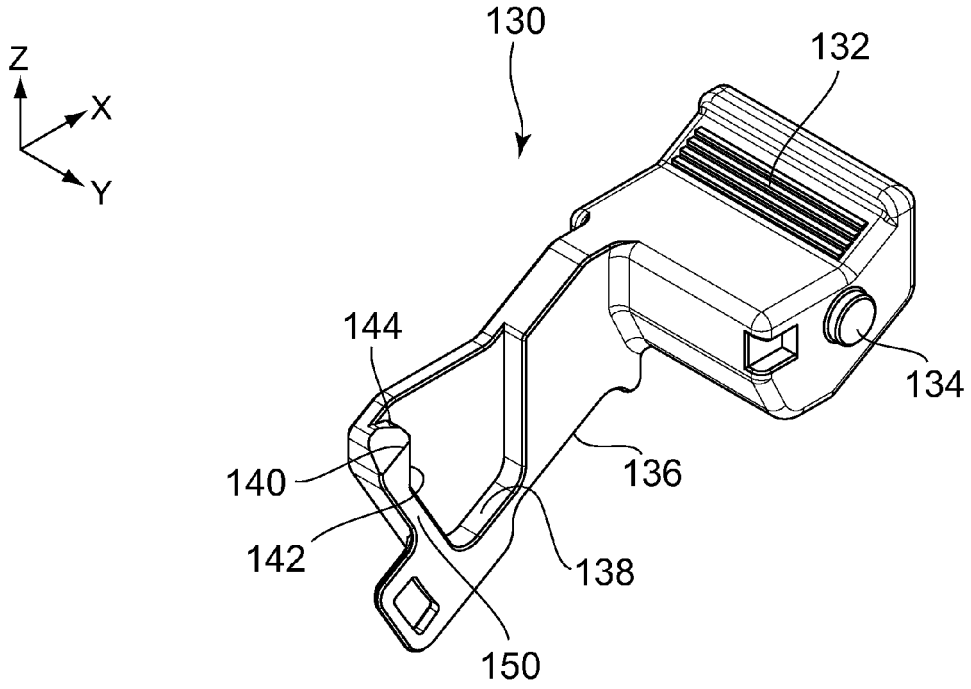
FIG. 3 is a perspective view showing the operation member of FIG. 2.

As shown in FIGS. 2 and 3, the operation member 130 includes an operation portion 132, guided portions 134, a supported portion 136, a press portion 138, a regulating portion 140 and a reinforcing portion 150. The operation portion 132 is a portion which is operated when the mating connector 200 (see FIG. 7) received in the connector 100 is moved in the ejecting direction. The operation portion 132 has a block-like shape. The guided portions 134 are protrusions which outwardly extend from the operation portion 132 toward orientations opposite to each other in the thickness direction. As shown in FIGS. 1 to 3, only one of the guided portions 134 is illustrated in those Figures. A remaining one of the guided portions 134 is formed behind the operation portion 132. In other words, the number of the guided portions 134 of the present embodiment is two. As understood from FIG. 1, the guided portions 134 are guided by the guide portions 114 of the holding member 110, respectively. Thus, the operation portion 132 can be essentially moved only in the up-down direction, i.e. ejecting direction and receiving direction, while pivoting on the guided portions 134.

As shown in FIGS. 10 and 15, the supported portion 136 is supported by the support portion 112 of the holding member 110. In detail, the supported portion 136 can be moved to be slid on the support portion 112 while an angle thereof with respect to the up-down direction is changed. In addition, as described above, the guide portions 114 and the guided portions 134 (see FIG. 1) regulate a movement of the operation portion 132 so that the operation portion 132 is moved only in the up-down direction while an angle thereof is changed. Accordingly, the operation member 130 is moved in a swinging motion as a whole. In other words, since the supported portion 136 is supported by the support portion 112, the operation member 130 is swingable.

The operation member 130 of the present embodiment is movable between a first position and a second position. As shown in FIGS. 7, 8 and 10, the first position is a position of the operation member 130 when the connector 100 receives the mating connector 200. In other words, when the connector 100 receives the mating connector 200, the operation member 130 is positioned at the first position. As shown in FIGS. 12, 13 and 15, the second position is another position of the operation member 130 when the operation portion 132 is operated to be pressed downward so that the mating connector 200 is pushed up to a position where the mating connector 200 can be easily pulled out from the connector 100.

As understood from FIGS. 10 and 15, when the operation member 130 is operated to be moved from the first position toward the second position, the press portion 138 presses the pressed portion 215 in the ejecting direction to move the mating connector 200 in the ejecting direction.

As understood from FIGS. 10, 11, 15 and 16, an operation of the operation member 130, more specifically, a pressing operation against the operation portion 132, causes the press portion 138 to press the pressed portion 215 so that the island-like protrusion 212 is moved in the ejecting direction. At that time, the regulated portion 220 is moved in the ejecting direction together with the island-like protrusion 212. When the regulated portion 220 is moved in the ejecting direction, the regulated portion 220 passes on a movement path. The movement path is referred to as "ejecting path". The regulating portion 140 of the present embodiment is provided so as to enter into the ejecting path at the latest until the operation member 130 reaches the second position. The entering of the regulating portion 140 regulates a movement of the regulated portion 220 in the ejecting direction. Specifically, when the mating connector 200 is pushed up to the position where the mating connector 200 can be easily pulled out from the connector 100, the regulating portion 140 is positioned on the ejecting path of the regulated portion 220. Accordingly, even if the mating connector 200 is nearly released off the connector 100 with force, the regulated portion 220 abuts the regulating portion 140 so that the mating connector 200 is prevented from being released off the connector 100 in the ejecting direction.

In particular, according to the present embodiment, when the mating terminal 230 (see FIG. 13) is positioned away from the terminals 120, force by which the connector 100 holds the mating connector 200 is rapidly decreased. Accordingly, if the connector 100 does not comprise the regulating portion 140, the mating connector 200 might be released off the connector 100 when the operation portion 132 continues to be pressed downward. Thus, the regulating portion 140 of the present embodiment is configured to enter into the ejecting path of the regulated portion 220 before the mating terminal 230 is positioned away from the terminals 120. More specifically, as understood from FIGS. 9, 11, 14 and 16, the regulating portion 140 is provided so as to be positioned on the ejecting path of the regulated portion 220 when the mating terminal 230 is moved in the ejecting direction so that the contact portions 122 of the terminals 120 are positioned away from the linear portions 232, respectively.

Figure 11:
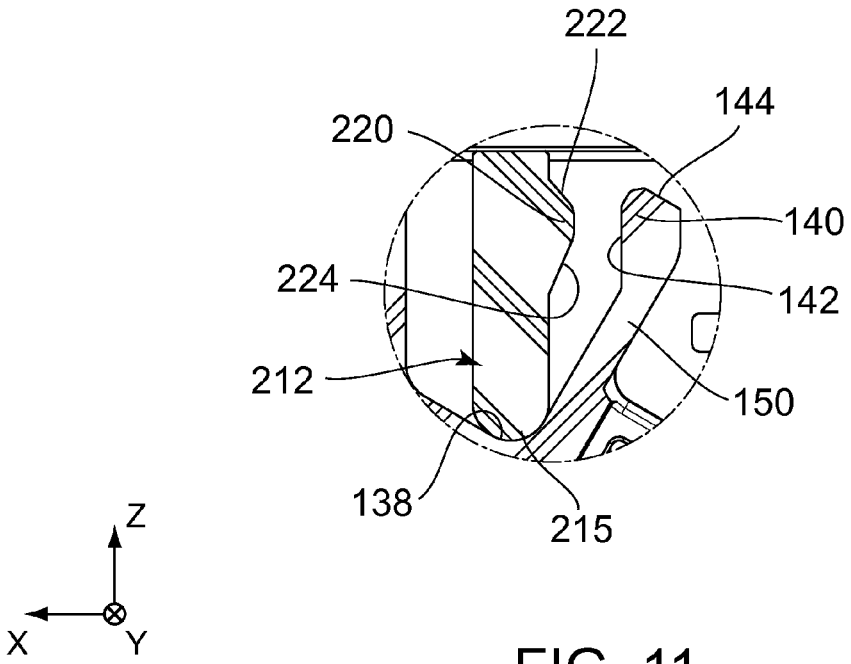
FIG. 11 is an enlarged view showing a part which is enclosed by a circle D of dashed-dotted lines of FIG. 10.
Figure 16:
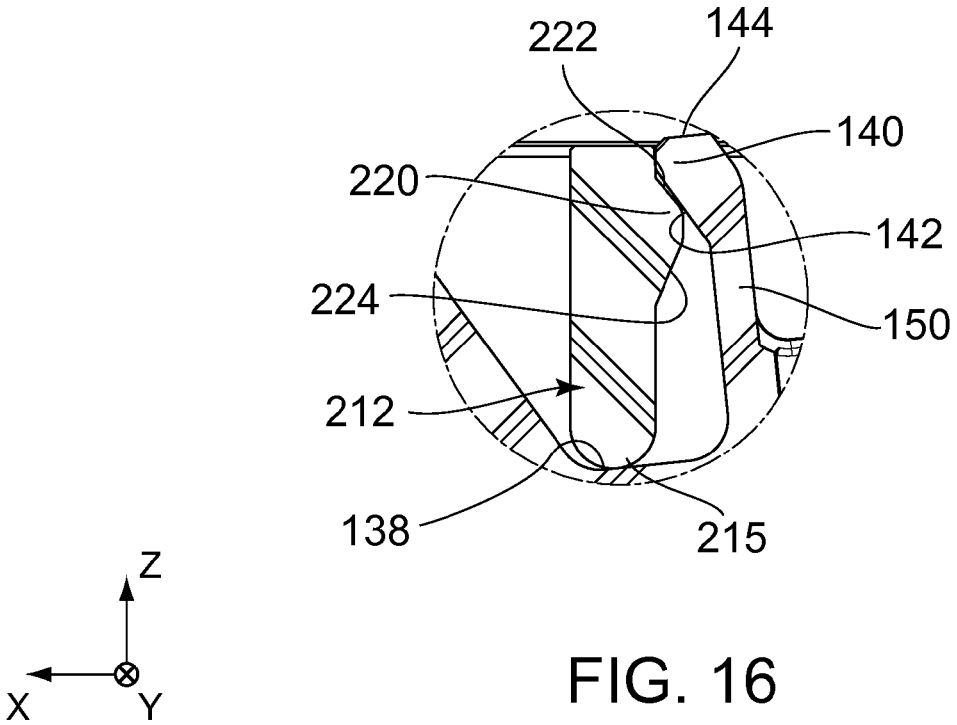
FIG. 16 is an enlarged view showing a part which is enclosed by a circle H of dashed-dotted lines of FIG. 15.
Figure 17:
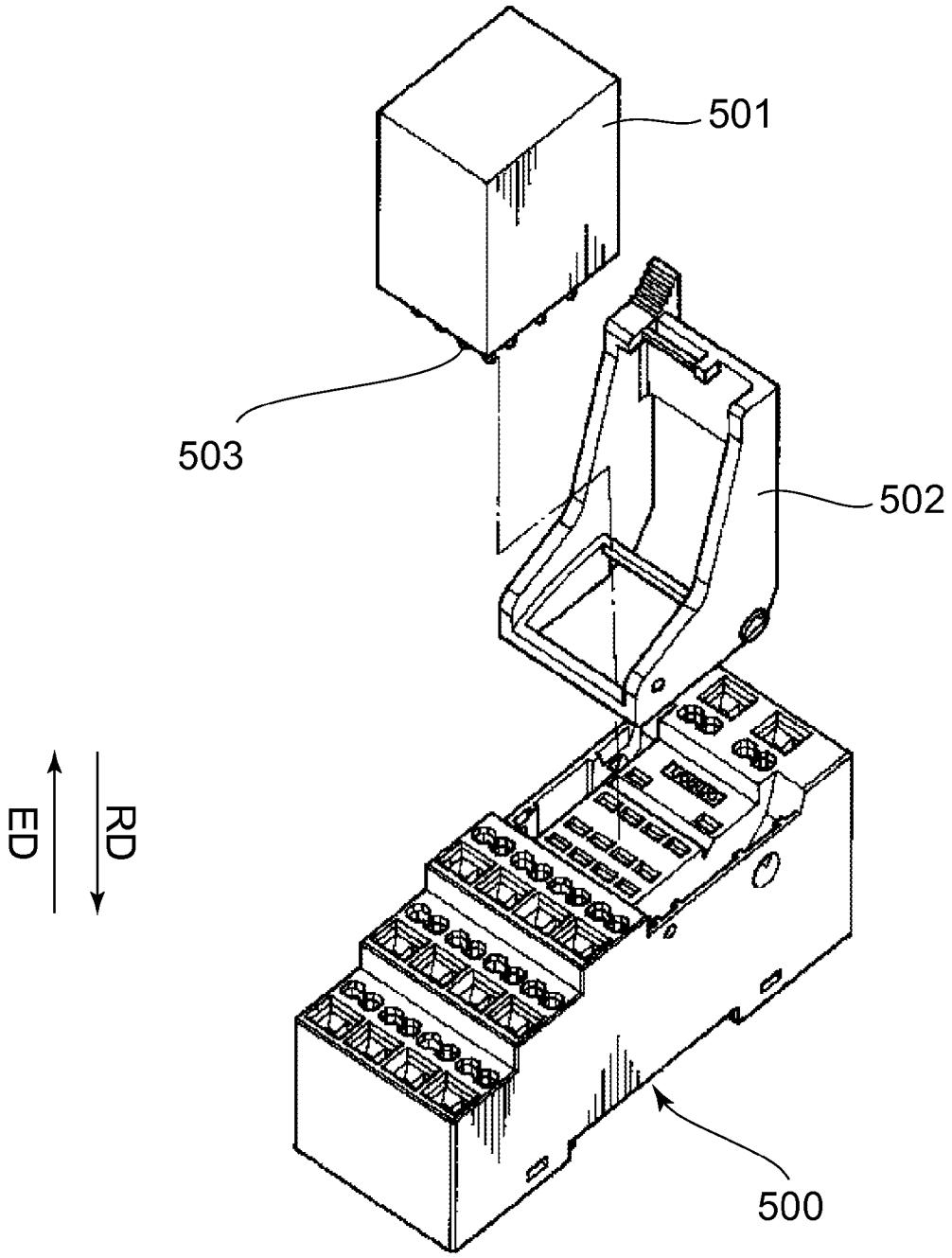
FIG. 17 PRIOR ART
FIG. 17 is an exploded, perspective view showing a connector of Patent Document 1.

As shown in FIGS. 11 and 16, the regulating portion 140 of the present embodiment has a contact surface 142 and a retraction surface 144. The contact surface 142 intersects with the ejecting direction. The retraction surface 144 intersects with the receiving direction.

As shown in FIGS. 15 and 16, when the operation member 130 is positioned at the second position, the regulating portion 140 and the regulated portion 220 are brought into contact with each other at the contact surfaces 142, 222. Accordingly, the mating connector 200 can be pulled out from the connector 100 when the operation of the operation member 130 is stopped. In detail, under a state where the operation portion 132 is operated to be pressed downward, the regulating portion 140 stays on the ejecting path of the regulated portion 220 so that the mating connector 200 cannot be pulled out from the connector 100. In a case where the mating connector 200 is about to be pulled out from the connector 100 after the operation of the operation member 130 is stopped, the contact surface 222 presses the contact surface 142 in the ejecting direction. Each of the contact surface 222 and the contact surface 142 intersects with the ejecting direction. Accordingly, when the contact surface 222 presses the contact surface 142 in the ejecting direction, the regulating portion 140 is moved to an outside of the ejecting path. Thus, the mating connector 200 can be easily pulled out from the connector 100. In the present embodiment, the regulating portion 140 and the regulated portion 220 are provided with the contact surface 142 and the contact surface 222, respectively, and each of the contact surfaces 142, 222 intersects with the ejecting direction. However, the present invention is not limited thereto. For example, if at least one of the regulating portion 140 and the regulated portion 220 is provided with the contact surface 142, 222 which intersects with the ejecting direction, the mating connector 200 can be easily pulled out from the connector 100 when the operation of the operation member 130 is stopped.

As understood from FIGS. 15 and 16, if the operation member 130 is positioned at the second position under a state where the mating connector 200 is pulled out from the connector 100, the regulating portion 140 is positioned on a receiving path before the mating connector 200 is inserted into and mated with the connector 100, i.e. before the connector 100 receives the mating connector 200. The receiving path is another movement path on which the regulated portion 220 passes when moved in the receiving direction. In the aforementioned situation, when the mating connector 200 is inserted into and mated with the connector 100, the regulated portion 220 abuts the regulating portion 140 in the receiving direction. At that time, the regulating portion 140 and the regulated portion 220 are brought into contact with each other at the retraction surfaces 144, 224 each of which intersects with the receiving direction, so that the regulating portion 140 is retracted from the receiving path. Accordingly, the connector 100 can smoothly receives the mating connector 200. Although the regulated portion 220 and the regulating portion 140 of the present embodiment are provided with the retraction surface 224 and the retraction surface 144, respectively, and each of the retraction surfaces 224, 144 intersects with the receiving direction. However, the present invention is not limited thereto. For example, if at least one of the regulated portion 220 and the regulating portion 140 is provided with the retraction surface 224, 144 which intersects with the receiving direction, the connector 100 can smoothly receives the mating connector 200 even if the regulating portion 140 is positioned on the receiving path of the regulated portion 220 when the connector 100 receives the mating connector 200.

As shown in FIG. 2, the operation member 130 has a first distance from the supported portion 136 to the regulating portion 140, and the operation member 130 has a second distance from the supported portion 136 to the press portion 138. Since the first distance is longer than the second distance, the regulating portion 140 can be largely moved when the press portion 138 is moved. Thus, as shown in FIG. 15, the regulating portion 140 surely regulates the regulated portion 220 while the regulating portion 140 can be prevented from unnecessarily inhibiting a movement of the regulated portion 220. In addition, the regulating portion 140, the supported portion 136 and the press portion 138 are triangularly positioned in a plane, or the XZ-plane, including the ejecting direction. Accordingly, the connector 100 can be prevented from having an increased size in the predetermined direction, or the X-direction.

As understood from FIG. 3, in the present embodiment, each of the press portion 138 and the regulating portion 140 has a predetermined thickness in the thickness direction. Furthermore, the reinforcing portion 150 has a thickness same as the predetermined thickness and couples the press portion 138 with the regulating portion 140. The operation of the operation member 130 causes the press portion 138 and the regulating portion 140 to receive large loads so that the operation member 130 might be damaged. However, the operation member 130 is provided with the reinforcing portion 150 so that the operation member 130 is prevented from being damaged.

Although the present invention has been described with specific examples, the present invention is not limited thereto. Various modifications and applications are possible with the present invention.

In the aforementioned embodiment, the connector device, more specifically, the service plug assembly, is described as an example. However, the object which is received in the connector 100 is not limited to the mating connector 200. The object may be a relay like that of Patent Document 1.

In the present embodiment, the connector 100 is provided with a single first set of the press portion 138 and the regulating portion 140 while the mating connector 200 is provided with a single second set of the pressed portion 215 and the regulated portion 220. However, the present invention is not limited thereto. For example, the operation member 130 may be provided with two first sets which face each other in the thickness direction while the mating connector 200 may be provided with two second sets which correspond to the two first sets, respectively.

The present application is based on a Japanese patent application of JP2014-129612 filed before the Japan Patent Office on Jun. 24, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector receivable an object along a receiving direction, the connector ejecting the object along an ejecting direction opposite to the receiving direction, wherein:

the object has a mating terminal, a pressed portion and a regulated portion;

when the object is moved in the receiving direction, the regulated portion is moved in the receiving direction together with the object;

when the object is moved in the ejecting direction, the regulated portion is moved in the ejecting direction together with the object;

the connector comprises a holding member, a terminal and an operation member;

the terminal is held by the holding member;

when the connector receives the object, the terminal is connected with the mating terminal;

the operation member is supported by the holding member so as to be movable between a first position and a second position;

when the connector receives the object, the operation member is positioned at the first position;

the operation member includes a press portion and a regulating portion;

when the operation member is operated to be moved from the first position toward the second position, the press portion presses the pressed portion in the ejecting direction to move the object in the ejecting direction; and at the latest until the operation member reaches the second position, the regulating portion enters into an ejecting path to regulate a movement of the regulated portion in the ejecting direction so that the regulating portion prevents the object from being released off the connector in the ejecting direction, the ejecting path being a movement path on which the regulated portion passes when moved in the ejecting direction.

2. The connector as recited in claim 1, wherein the regulating portion enters into the ejecting path before the mating terminal is positioned away from the terminal.

3. The connector as recited in claim 1, wherein:

the terminal has a dog-leg like contact portion;

in a plane including the ejecting direction, the mating terminal has a cross-sectional shape including a linear portion and a tapered portion which is positioned at an end of the linear portion; and when the mating terminal is moved in the ejecting direction so that the contact portion of the terminal is positioned away from the linear portion, the regulating portion is positioned on the ejecting path of the regulated portion.

4. The connector as recited in claim 1, wherein:

at least one of the regulating portion and the regulated portion has a contact surface which intersects with the ejecting direction; and when the operation member is positioned at the second position, the regulating portion and the regulated portion are brought into contact with each other at the contact surface.

5. The connector as recited in claim 1, wherein:

each of the press portion and the regulating portion has a predetermined thickness in a thickness direction perpendicular to the receiving direction; and the press portion and the regulating portion are coupled with a reinforcing portion which has a thickness same as the predetermined thickness.

6. The connector as recited in claim 1, wherein:

at least one of the regulating portion and the regulated portion has a retraction surface which intersects with the receiving direction; and in a case where the regulating portion is positioned on a receiving path when the connector receives the object, the regulating portion and the regulated portion are brought into contact with each other at the retraction surface so that the regulating portion is retracted from the receiving path, the receiving path being another movement path on which the regulated portion passes when moved in the receiving direction.

7. The connector as recited in claim 1, wherein:

the holding member has a support portion;

the operation member has a supported portion which is supported by the support portion;

the supported portion is supported by the support portion so that the operation member is swingable;

the operation member has a first distance from the supported portion to the regulating portion;

the operation member has a second distance from the supported portion to the press portion; and the first distance is longer than the second distance.

8. The connector as recited in claim 7, wherein the regulating portion, the supported portion and the press portion are triangularly positioned in a plane including the ejecting direction.

9. A connector device comprising the connector as recited in claim 1 and a mating connector as the object, wherein:

the mating connector comprises a mating holding member which holds the mating terminal; and the pressed portion and the regulated portion are provided on the mating holding member.

* * * * *